United States Patent [19]

Barten

[11] Patent Number: 4,751,425

[45] Date of Patent: Jun. 14, 1988

[54] COLOR DISPLAY TUBE WITH LINE SCREEN HAVING REDUCED MOIRÉ

[75] Inventor: Piet G. J. Barten, Eindhoven, Netherlands

[73] Assignee: U.S. Phillips Corporation, New York, N.Y.

[21] Appl. No.: 837,623

[22] Filed: Mar. 10, 1986

[30] Foreign Application Priority Data

Mar. 14, 1985 [NL] Netherlands ..... 8500734

[51] Int. Cl.[4] ..... H01J 29/07

[52] U.S. Cl. ..... 313/403

[58] Field of Search ..... 313/402, 403, 408

[56] References Cited

U.S. PATENT DOCUMENTS 3,486,061 12/1969 Barten ..... 313/408

3,973,159 8/1976 Barten ..... 313/403

*Primary Examiner*—David K. Moore

*Assistant Examiner*—K. Wieder

*Attorney, Agent, or Firm*—John C. Fox

[57] ABSTRACT

A color display tube in which the bridges between the apertures of the color selection electrode are situated substantially on substantially straight lines in the plane of the color selection electrode, which lines enclose an angle between 3° and 8° with the horizontal direction of deflection, effectively suppressing the occurrence of moiré-patterns.

2 Claims, 1 Drawing Sheet

COLOR DISPLAY TUBE WITH LINE SCREEN HAVING REDUCED MOIRÉ

BACKGROUND OF THE INVENTION

The invention relates to a color display tube comprising in an evacuated envelope an electron gun system for generating three electron beams which are situated with their axes in one plane and which in the operating tube are deflected over a display screen in two mutually perpendicular directions, which plane extends in a first direction of deflection, said display screen comprising patterns of areas luminescing in different colors, there being provided in front of the said display screen a color selection electrode which comprises rows of substantially rectangular apertures, the rows extending substantially parallel to the second direction of deflection and the apertures in each row being separated from each other by bridges, said apertures having a substantially equal pitch in the direction of the rows, and the apertures of juxtaposed rows being staggered with respect to each other.

Such a colour display tube is known from U.S. Pat. No. 3,973,159. This Specification dicloses a color display tube having a colour selection electrode, sometimes termed shadow mask, comprising parallel rows of apertures. These rows of apertures are staggered in known manner in n steps with respect to each other so as to reduce moiré-patterns. Moiré-patterns are bright and dark bands which are formed in the displayed picture by interference of inter alia the lines of the field from which the picture is built up with the pattern of the apertures in the colour selection electrode. Both the lines of the field and the pattern of the apertures show a periodicity from which the occurrence of the bright and dark bands by interference can simply be explained. In order to further reduce the moiré-patterns, the above-mentioned U.S. Pat. No. 3,973,159 suggests choosing the space between the apertures in the direction of the rows to be equal to p/n, wherein p is the pitch in the direction of the rows between the apertures. However, this measure has not proved to be totally satisfactory in practice.

It has moreover been found that for a color display tube which is destined for use in one special transmission system and in which a given number of scanning lines per picture and consequently a given line spacing occurs, the mutual space between the apertures in the colour selection electrode should be chosen in a specific manner in relation to the line spacing so as to minimize moiré-effects, if any. However, in these optimum conditions, too, moiré-effects which are still visible may occur with a small dimension of the spot of the electron beam on the display screen in the second direction of deflection. In colour display tubes of the "in-line" type, this is the case especially on the left-hand and on the right-hand sides of the display screen. The possibility that moiré-effects are still observed exists also if deviations occur as a result of the non-linearity of the picture time base. Furthermore, the choice of the space between the apertures is restricted because different line spacings have to be taken into account if the display tube is to be suitable for different transmission systems.

In order to mitigate these disadvantages, U.S. Pat. No. 3,486,061 suggests making the smallest angle between the second direction of deflection and the rows of apertures in the color selection electrode between 5° and 10°. The occurrence of visible moiré-patterns is then strongly reduced. In the color display tube described in the said Patent Specification, three electron beams are generated which are situated with respect to each other such that in the electron gun system the cross-sections of the axes of the beams with a plane perpendicular to the tube axis constitute the corners of an equilateral triangle. This is a so-called "delta" gun arrangement. One side of the said triangle is substantially parallel to the scanning lines. It is of importance that the relationship between the location of the electron beams and the rows of, in this case circular, apertures in the colour selection electrode is maintained. Since according to the U.S. Pat. No. 3,486,061 the smallest angle between the direction at right angles to the scanning lines and the rows of apertures in the colour selection electrode is between 5° and 10°, this should hence also apply to the smallest angle between the direction of the scanning lines on the display screen and the side at the triangle formed by the electron beams in the electron gun system. This can be achieved by rotating, during the assembly of the color display tube, the electron gun system about its axis over the relevant angle between 5° and 10° with respect to the usual assembly position.

The rotation of the electron gun system in a colour display tube of the "in-line" type, in which three electron beams are generated which are situated with their axes in one, usually horizontal, plane, is not attractive since this will present problems in convergence.

It is therefore an object of the invention to provide an "in-line" colour display tube of the kind described in the opening paragraph in which the occurrence of moiré-patterns is effectively suppressed and in which it is not necessary to rotate the electron gun system.

SUMMARY OF THE INVENTION

According to the invention, a color display tube of the kind mentioned in the opening paragraph is characterized in that the bridges between the apertures are positioned substantially on substantially straight lines which enclose an angle between 3° and 8° with the first direction of deflection. The normal orientation of the "in-line" electron gun system can be maintained, as well as the usual orientation of the pattern of luminescent areas. The only variation is a shift of the bridges so that they are positioned substantially on substantially straight lines which enclose an angle between 3° and 8° with the first direction of deflection, as will be explained in detail hereinafter.

A preferred embodiment of a color display tube according to the invention is characterized in that the apertures are staggered with respect to each other in such a manner that alternately a bridge and the centre of an aperture are situated substantially on the said substantially straight line. Experiments have demonstrated that in that case the moiré-effects can be drastically reduced.

BRIEF DESCRIPTION OF THE DRAWINGS

An embodiment of the invention will now be described in greater detail, by way of example, with reference to the accompanying drawing, in which.

DESCRIPTION OF THE PREFERRED EMBODIMENTS

Figure 1:
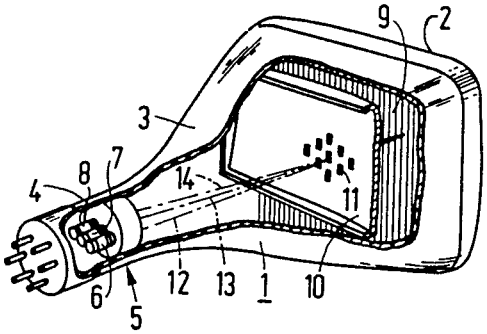
FIG. 1 is a perspective view partly broken away, of a color display tube according to the invention.

Referring to FIG. 1, the tube comprises a glass envelope 1 consisting of a display window 2, a cone 3, and a neck 4. An electron gun system 5 consisting of three electron guns 6, 7 and 8 situated with their axes in one plane is provided in the neck 4. A display screen 9 is provided on the inside of the display window 2. This screen comprises a large number of triplets of phosphor lines or rows of discrete elongate dots or stripes luminescing blue, green and red. At a short distance in front of the display screen 9 a colour selection electrode 10 is present which consists of a metal plate in which a large number of rows of substantially rectangular apertures 11 are provided. The apertures in FIG. 1 are diagrammatic only and are not drawn to scale. The three electron beams 12, 13 and 14 converge on the display screen 9 after having passed through the apertures 11 in the color selection electrode. Because the electron beams make a small angle with each other, the so-called color selection angle, they each impinge only on phosphor regions of one colour.

Figure 2:
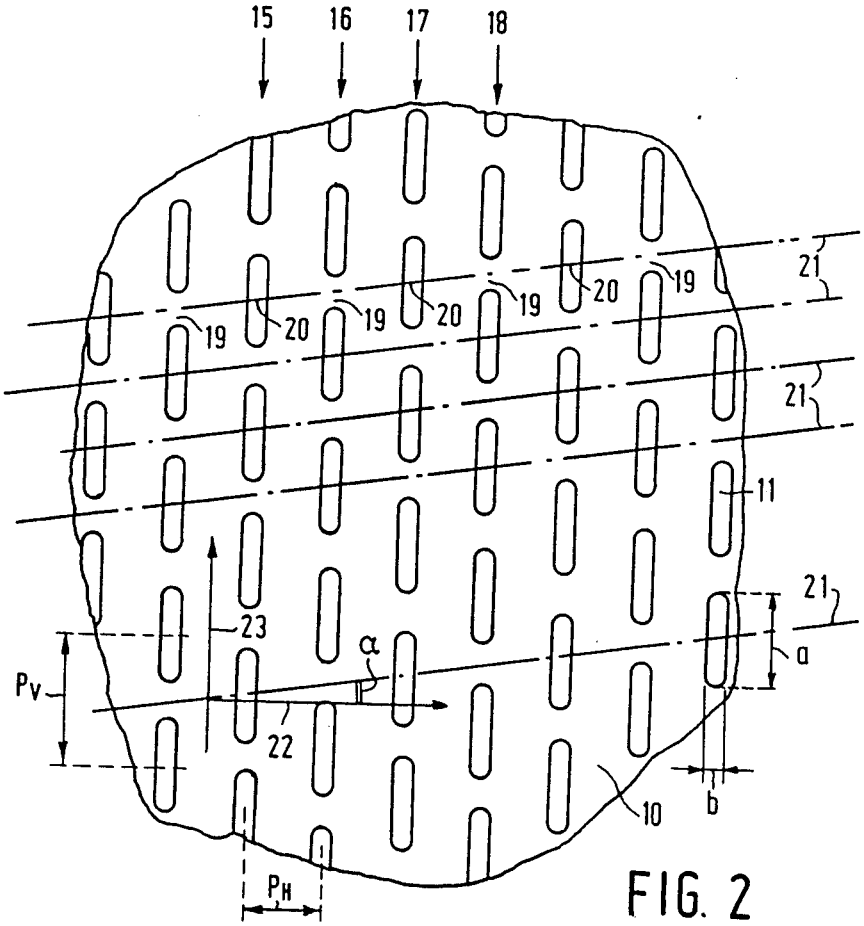
FIG. 2 shows diagrammatically a part of the pattern of apertures in the color selection electrode of the tube shown in FIG. 1.

FIG. 2 shows a part of the color selection electrode 10. The apertures are arranged in rows a few of which are denoted by 15, 16, 17 and 18. The longitudinal direction of these rows is parallel to the second direction of deflection 23 and to the longitudinal direction of the phosphor stripes of the display screen 9 and in normal use of the tube it is vertical. The apertures 11 in the various rows are staggered with respect to each other. The length a of the apertures is 0.75 mm, the width b is 0.14 mm, the horizontal pitch $P_H$ near the edge of the mask is 800 $\mu$m and the vertical pitch $P_V$=850 $\mu$m. In this case the rows are staggered once with respect to each other and the bridges 19 and the centres 20 of the apertures 11 are situated alternately on lines 21 which, according to the invention, enclose an angle $\alpha$ between 3° and 8°, in this case 4°, with the first direction 22 of deflection. For angles $\alpha$ exceeding 8° and smaller than 3°, improvement with respect to the occurrence of moiré-effects is not visible.

The invention is not restricted to the type of color selection electrode described. Electrodes can also be manufactured in which more staggering takes place between the rows or in which the centres of the apertures are not situated on the said straight lines. The gist of the invention is that the bridges are situated on substantially straight lines which enclose an angle $\alpha$ between 3° and 8° with the first (horizontal) direction of deflection.

What is claimed is:

1. A color display tube comprising in an evacuated envelope: an in-line electron gun system for generating three electron beams having their undeflected axes in one plane, the plane extending in a first direction of beam deflection; a display screen comprising patterns of areas luminescing in different colors; a color selection electrode in front of the display screen, the electrode comprising rows of substantially rectangular apertures, the rows extending substantially perpendicular to the plane extending in the first direction of deflection, and substantially parallel to a second direction of beam deflection, the apertures having a substantially equal pitch in the direction of the rows, the apertures in each row being separated from each other by bridges, and the apertures of juxtaposed rows being staggered with respect to each other, characterized in that the bridges between the apertures are situated substantially on substantially straight lines in the plane of the color selection electrode, which lines form an angle of from about 3° to 8° with respect to the first direction of deflection to reduce moiré caused by the in-line gun system.

2. A color display tube as claimed in claim 1, characterized in that the apertures are staggered with respect to each other in such a manner that alternately a bridge and the center of an aperture are situated substantially on the said substantially straight line.

* * * * *